US010786715B2

(12) United States Patent
Wang

(10) Patent No.: US 10,786,715 B2
(45) Date of Patent: Sep. 29, 2020

(54) ASSEMBLED GOLF BAG

(71) Applicant: Shenzhen Aobao Plastic Products Co., Ltd, Shenzhen, Guangdong (CN)

(72) Inventor: Qiong Wang, Guangdong (CN)

(73) Assignee: Youli Wang, Shenzhen (CN)

( * ) Notice: Subject to any disclaimer, the term of this patent is extended or adjusted under 35 U.S.C. 154(b) by 325 days.

(21) Appl. No.: 16/004,480

(22) Filed: Jun. 11, 2018

(65) Prior Publication Data

US 2018/0369663 A1 Dec. 27, 2018

(30) Foreign Application Priority Data

Jun. 25, 2017 (CN) ..... 2017 1 0490198

(51) Int. Cl.
*A63B 55/40* (2015.01)
*A63B 102/32* (2015.01)

(52) U.S. Cl.
CPC ..... *A63B 55/40* (2015.10); *A63B 2102/32* (2015.10); *A63B 2210/50* (2013.01)

(58) Field of Classification Search
CPC .. A63B 55/40; A63B 2102/32; A63B 2210/50
See application file for complete search history.

(56) References Cited

U.S. PATENT DOCUMENTS 3,901,299 A * 8/1975 Picco ..... A63B 55/40 206/315.4
4,263,950 A * 4/1981 Brown ..... A63B 55/00 206/315.6
4,673,070 A * 6/1987 Ambal ..... A45C 3/00 150/111
8,757,373 B2 * 6/2014 Aubery ..... A63B 55/00 206/315.7
9,216,335 B2 * 12/2015 Cheng ..... A63B 55/57
9,713,754 B2 * 7/2017 Herron ..... A63B 55/00
9,808,686 B2 * 11/2017 Pactanac ..... A63B 55/40
10,610,751 B2 * 4/2020 Martell ..... A63B 55/53
2003/0094390 A1 * 5/2003 Thompson ..... A63B 55/408 206/315.5
2007/0138040 A1 * 6/2007 Chan ..... A63B 55/00 206/315.3
2008/0006548 A1 * 1/2008 Shiao ..... A63B 55/40 206/315.3

* cited by examiner

*Primary Examiner* — Tri M Mai
(74) *Attorney, Agent, or Firm* — Wayne & Ken, LLC; Tony Hom

(57) ABSTRACT

The invention relates to an assembled golf bag. The assembled golf bag includes an upper frame, a bottom frame, a support rod, a main body piece, a secondary body piece and a handle. The upper frame, the bottom frame and the primary body piece of the bag are fixed integrally by rivets. The support rod and the main body piece having clamping slot are assembled with the secondary body piece having clamping piece in a fastening and twisting manner, so that the secondary body piece can be easily removed and replaced. Sizes and colors of the handle can be changed by placing different color strips on the handle body. The invention has the advantages that the body piece of the ball bag can be freely matched according to the demand, the replacement is easy and the maintenance is convenient, and the parts on the bag can be recycled.

12 Claims, 13 Drawing Sheets

ASSEMBLED GOLF BAG

FIELD OF THE INVENTION

The present invention relates to the field of fitness and entertainment equipment, in particular to an assembled golf bag.

BACKGROUND OF THE INVENTION

The traditional golf bag is composed of an upper frame, a bottom frame, bag body pieces and support rod. All the fittings are fixed with one another to form a whole body in a stitching and riveting mode and cannot be repeatedly used once being fixed.

At present, in the existing technology, many patented golf bags are assembled by matching secondary frame with the upper frame and the bottom frame; and the body piece is an integral piece, and the work is complicated. Once the assembling is completed, it is difficult for the non-professional personnel to dismantle and modify.

China discloses a "golf bag capable of being freely assembled and disassembled" with the patent number 2016204336463. An assembly mode of the patent is as follows: the upper frame, the body pieces and the bottom frame are connected with one another through inserting buckles, and the vulnerable inserting buckles are disassembled by the non-professional persons once assembly is finished. Each body piece is a whole body with complicated workmanship, and the rework amount loss is huge once a certain part of the body piece is damaged.

Because a product is in structure design with complicated workmanship and splicing, when being damaged, a part of the golf bag must be returned for repair or scraped, so that resources cannot be reasonably utilized, and environmental protection is not facilitated; and the body pieces of the product give small selection space to a consumer, the consumer cannot arbitrarily combine the body pieces, and the resources are wasted.

The size of a handle on the golf bag is fixed; and the handle, of which the size is suitable for the consumers, cannot be selected according to different needs of the consumers.

In view of the defects of the product, the present invention aims to provide a novel assembled golf bag.

SUMMARY OF THE INVENTION

The objective of the present invention is to overcome the deficiencies of the prior art, so as to provide a golf bag capable of being freely assembled and disassembled. The golf bag comprises an upper frame, a bottom frame and main body pieces which are fixed with one another to form a whole body through rivets. support rod with clamping grooves and secondary body piece with clamping strips adopt an obvious assembly mode of the clamping strips, the clamping grooves and buttons, and the secondary body piece can be ensured to be easily disassembled and replaced. The matching form of the sizes and the colors of the handle can be changed by loading adhesive tapes with different colors and different sizes on a handle body. All the fittings of the assembled golf bag are independent, so that the golf bag which is more suitable for the consumer can be assembled by the consumer.

The objective of the present invention can be achieved through the following technical scheme:

The assembled golf bag comprises the upper frame, the bottom frame, the support rod, the main body pieces, the secondary body piece and the handle.

The handle which can be freely assembled is composed of two parts, i.e., a handle body and adhesive tapes; the handle body is provided with grooves; and barbs are arranged at both ends of the handle body respectively; the adhesive tapes have different sizes and colors and are put into the grooves of the handle body respectively; both ends of the adhesive tapes can be hung on the barbs which are arranged at both ends of the handle body respectively; upper frame support rod holes are formed in the upper frame; bottom frame support rod holes and buckling feet are formed in the bottom frame; the outer wall of each support rod is provided with a support rod clamping groove; grid bar are arranged in the main body pieces; a plurality of main body piece clamping groove strips are arranged on the outer wall of the main body piece; main body piece buttons are arranged at the upper end and the lower end of the main body piece respectively; and the clamping strips are arranged on the outer wall of the secondary body piece, and secondary body piece buttons are arranged at the upper end and the lower end of the secondary body piece respectively.

Further, the clamping strips are arranged in the support rod clamping grooves in a clamping mode, so that the secondary body piece are put among a plurality of support rod.

Further, each main body piece clamping groove strip is provided with a clamping groove, and each clamping strip is arranged in the clamping groove in the clamping mode, so that the secondary body piece are put among the plurality of main body piece clamping groove strips.

Further, each main body piece clamping groove strip is provided with a clamping groove; one of the clamping strips is arranged in the support rod clamping groove in the clamping mode; and the other clamping strip is arranged in the clamping groove in the clamping mode, so that the secondary body piece are arranged among the support rod and the main body piece clamping groove strips.

Further, the main body piece buttons are correspondingly buckled with the secondary body piece buttons.

Further, the support rod clamping grooves, the clamping grooves, the clamping strips and the handle adhesive tapes can be in any shape of a circular shape, an oval shape, a square shape and a polygonal shape.

The splicing mode of the assembled golf bag of the present invention is as follows:

First, the upper frame, the bottom frame and the main body pieces are fixed with one another to form a whole body through rivets; then a plurality of support rod, of which the outer walls are provided with the support rod clamping grooves respectively, are loaded, and buckling feet on the bottom frame are buckled after the support rod are fixed to the upper frame support rod holes and the bottom frame support rod holes respectively; and finally, all the clamping strips of the secondary body piece are clamped into the support rod hole clamping grooves of two different support rod or the clamping grooves of two different main body piece clamping groove strips or are clamped into the support rod clamping grooves and the clamping grooves of the main body piece clamping groove strips for correspondingly buckling the main body piece buckling buttons and the secondary body piece buckling buttons to complete the assembling.

Compared with the prior art, the assembled golf bag of the present invention has the beneficial effects that different styles of the golf bag body pieces can be easily replaced; as long as the secondary body piece of the golf bag are independently replaced, the golf bag can be used as a new product; and the size and the color of the handle can be freely changed according to different needs.

REFERENCE NUMERALS

Figure 1:
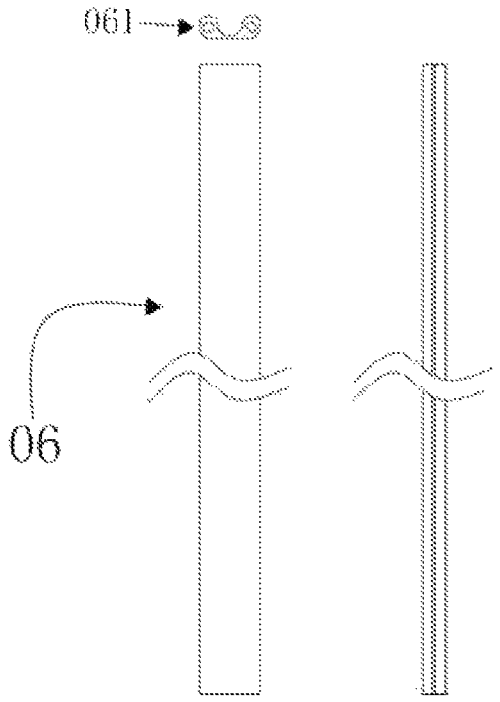
FIG. 1 shows three views of main body piece clamping groove strips of an assembled golf bag.

01—upper frame; 02—main body piece; 03—bottom frame; 04—upper frame support rod hole; 05—bottom frame support rod hole; 06—main body piece clamping groove strip; 061—clamping groove; 07—main body piece first stitch; 08—grid bar; 09—main body piece second stitch; 101—main body piece button; 102—secondary body piece button; 11—rivet; 12—support rod; 121—support rod clamping groove; 13—clamping strip; 14—secondary body piece; 15—secondary body piece stitch; 16—buckling foot; 17—main body piece inner wall; 18—handle body; 19—handle groove; 20—handle barb; 21—adhesive tape; 22—fixing stitch; and 23—handle.

DETAILED DESCRIPTION OF THE INVENTION

As shown in FIG. 1 to FIG. 10, the golf bag of the present invention is composed of an upper frame 01, main body pieces 02, a bottom frame 03, a handle 23, support rod 12 and secondary body piece 14.

Figure 2:
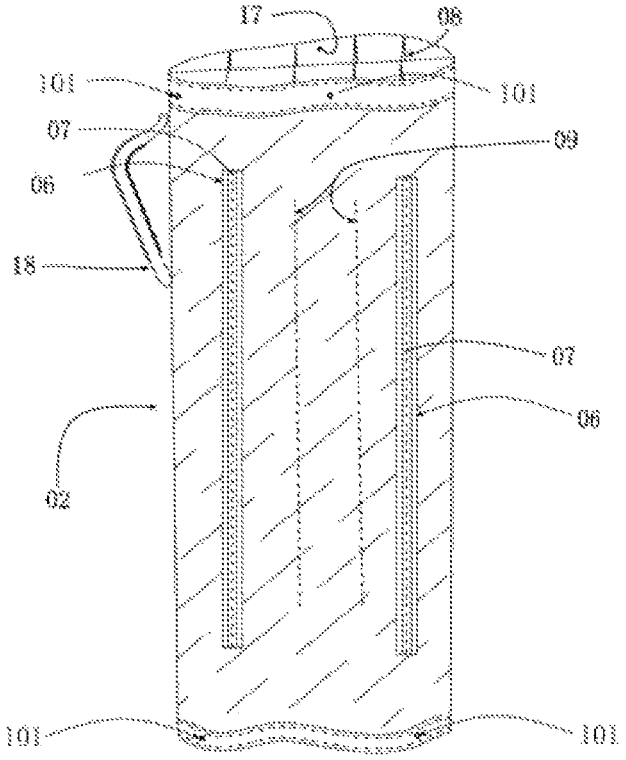
FIG. 2 is a three-dimensional view of a main body piece of an assembled golf bag.
Figure 3:
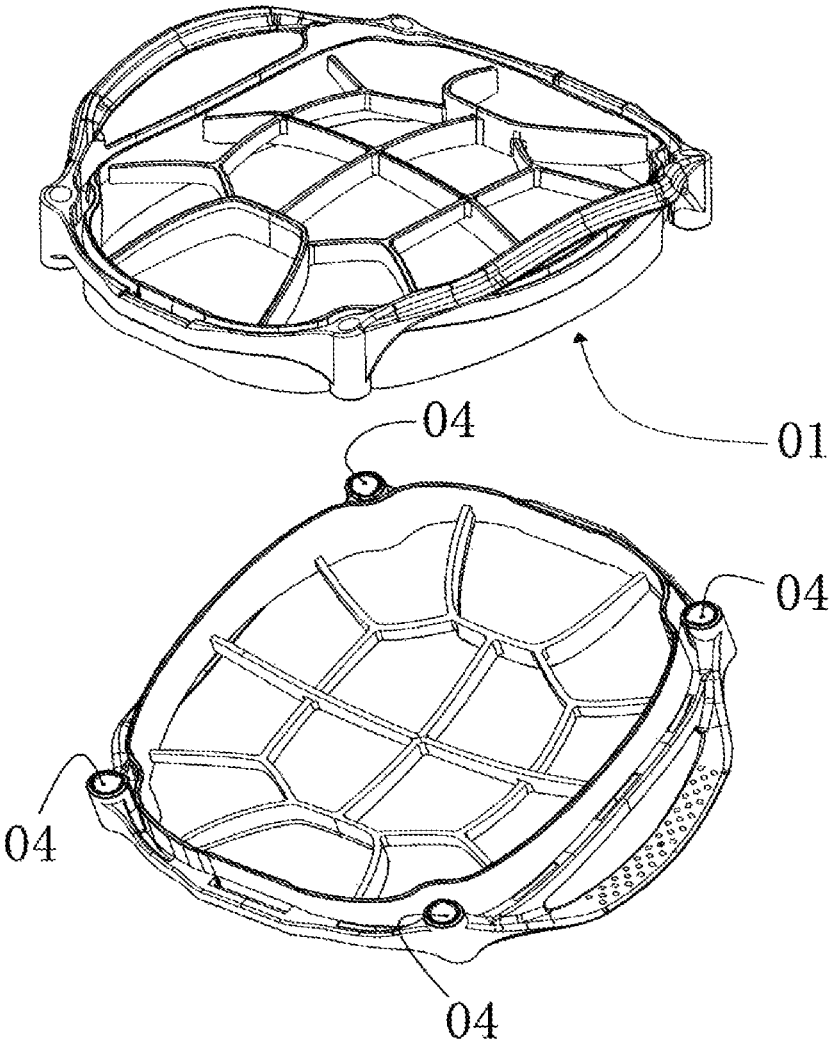
FIG. 3 is a three-dimensional view of an upper frame of an assembled golf bag.
Figure 4:
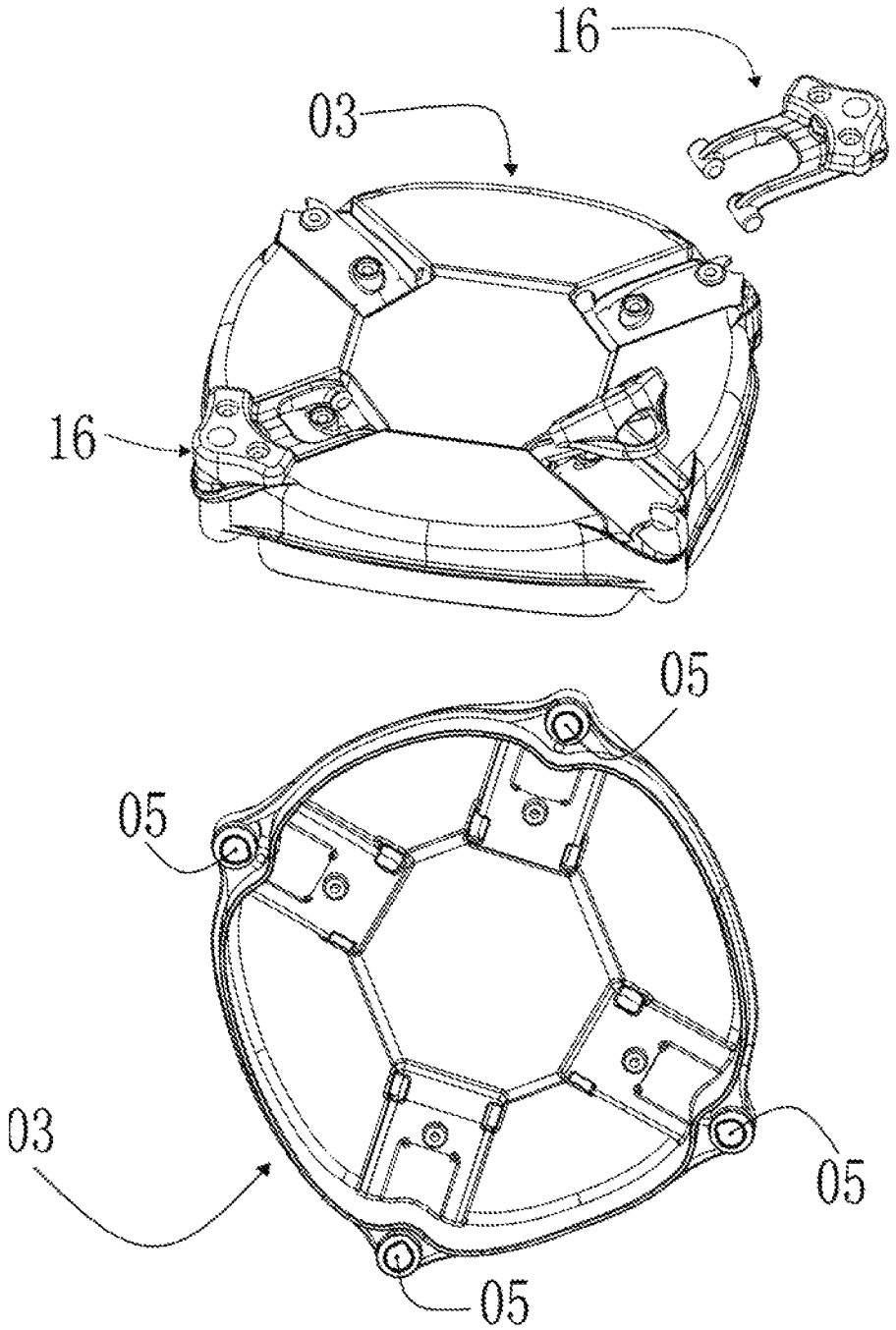
FIG. 4 is a three-dimensional view of a bottom frame of the assembled golf bag.
Figure 7:
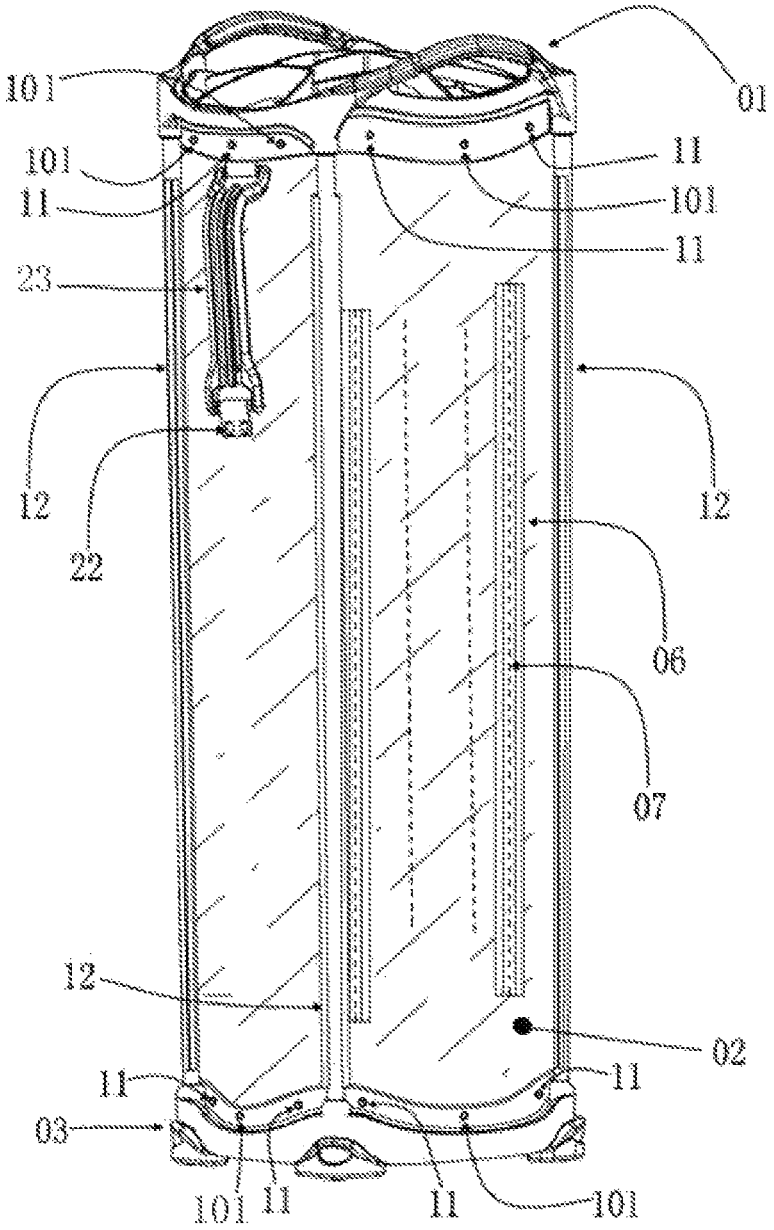
FIG. 7 is a three-dimensional view after an upper frame, a bottom frame, support rod and main body pieces of an assembled golf bag are combined into a whole body.

As shown in FIG. 1, FIG. 2 and FIG. 7, grid bar 08 are fixed to the inner walls 17 of the main body pieces through main body piece second stitches 09 firstly; main body piece clamping groove strips 06 are fixed to the outer walls of the main body pieces 02 through main body piece first stitches 07; and main body piece button 101 is arranged at the upper end and the lower end of the main body pieces respectively.

The handle 23 comprises a handle body 18 and adhesive tapes 21; the upper end of the handle body 18 is fixed to the main body pieces 02 through rivets 11; and the lower end of the handle body 18 is fixed to the main body pieces 02 through fixing stitches 22.

Figure 5:
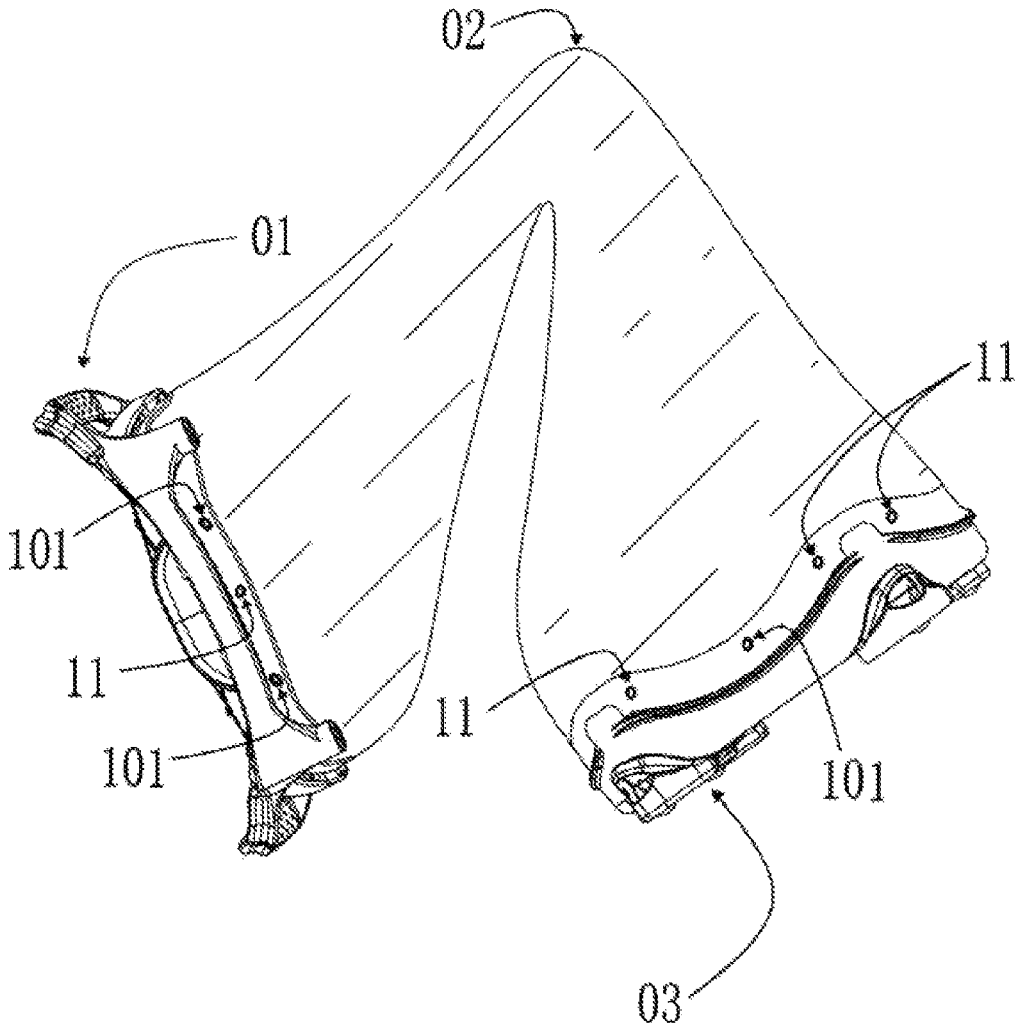
FIG. 5 is a folding view after an upper frame, a bottom frame and main body pieces of an assembled golf bag are combined into a whole body.

As shown in FIG. 5, the upper frame 01, the main body pieces 02 and the bottom frame 03 are fixed to form a whole body through the rivets 11, so that folding is convenient, and conservation of a transportation space is facilitated.

Figure 6:
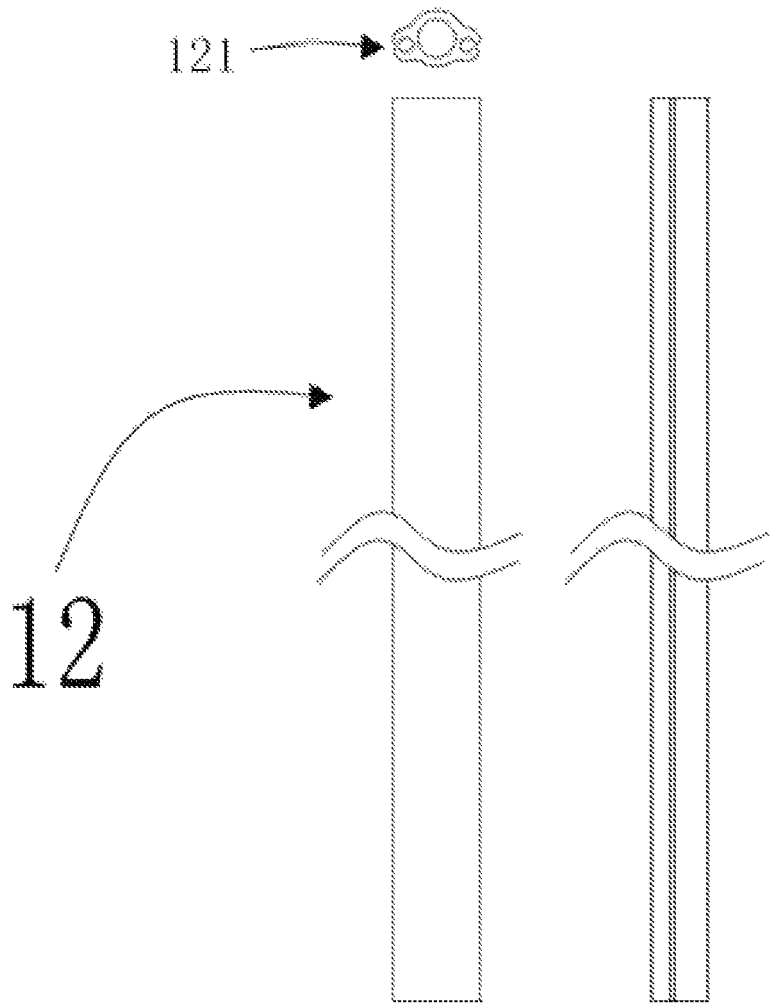
FIG. 6 shows three views that each support rod clamping groove is sleeved on each support rod of an assembled golf bag.

As shown in FIG. 6, support rod clamping groove 121 is sleeved on the corresponding support rod 12 to be fixed as a whole.

As shown in FIG. 1 to FIG. 7, after the upper frame 01, the main body pieces 02 and the bottom frame 03 are fixed to form a whole body, both ends of the support rod 12 are fixed in the corresponding upper frame support rod holes 04 and the corresponding bottom frame support rod holes 05, and the buckling feet 16 on the bottom frame 03 are buckled, so that the support rod are fixed to brace and straighten the golf bag.

Figure 8:
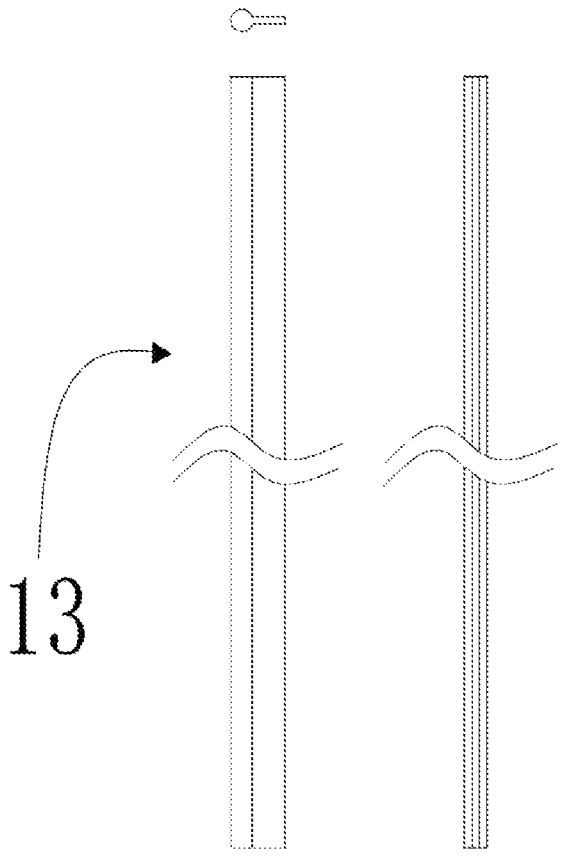
FIG. 8 shows three views of a clamping strip of an assembled golf bag.
Figure 9:
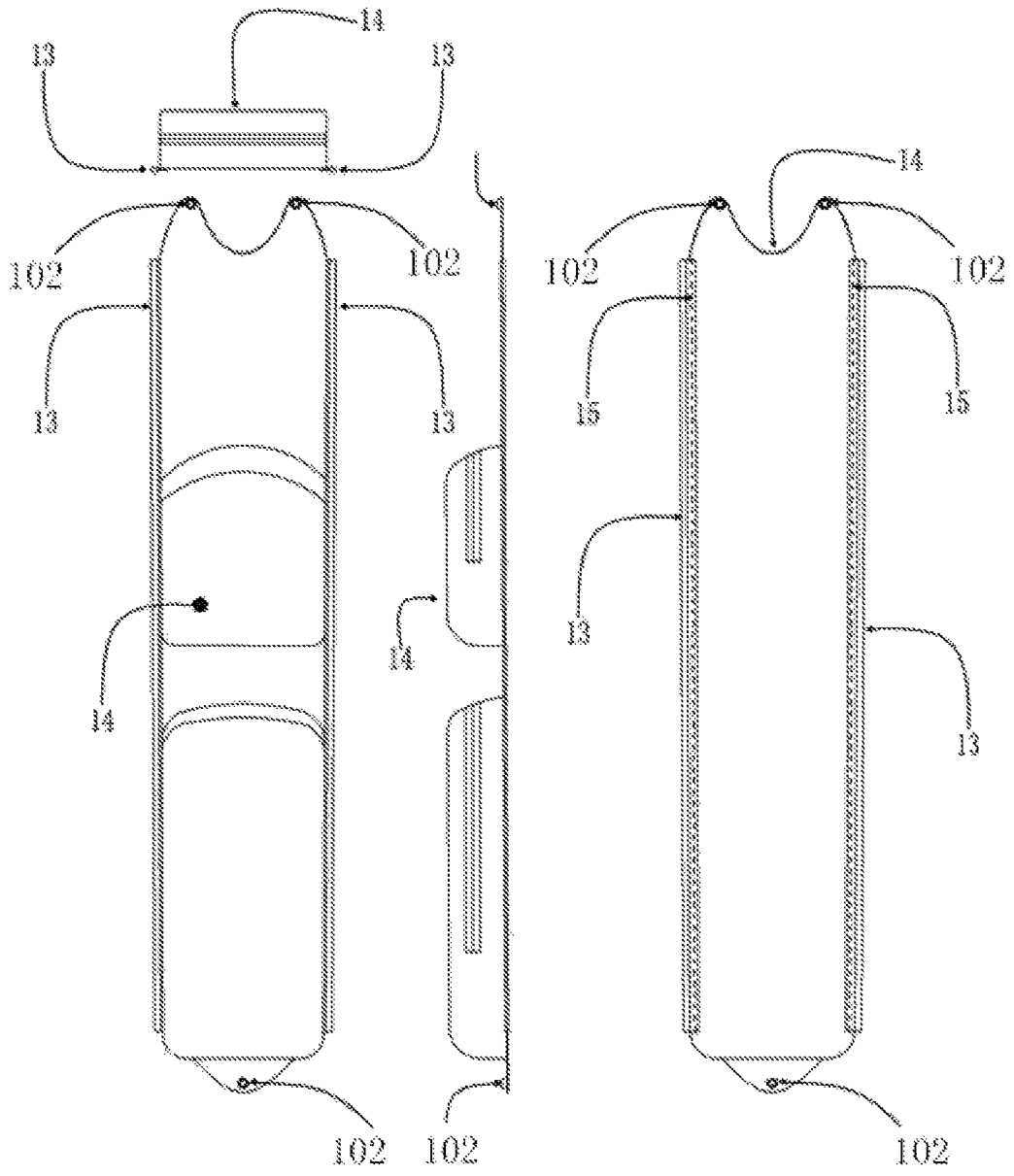
FIG. 9 shows three views of a secondary body piece of an assembled golf bag.
Figure 10:
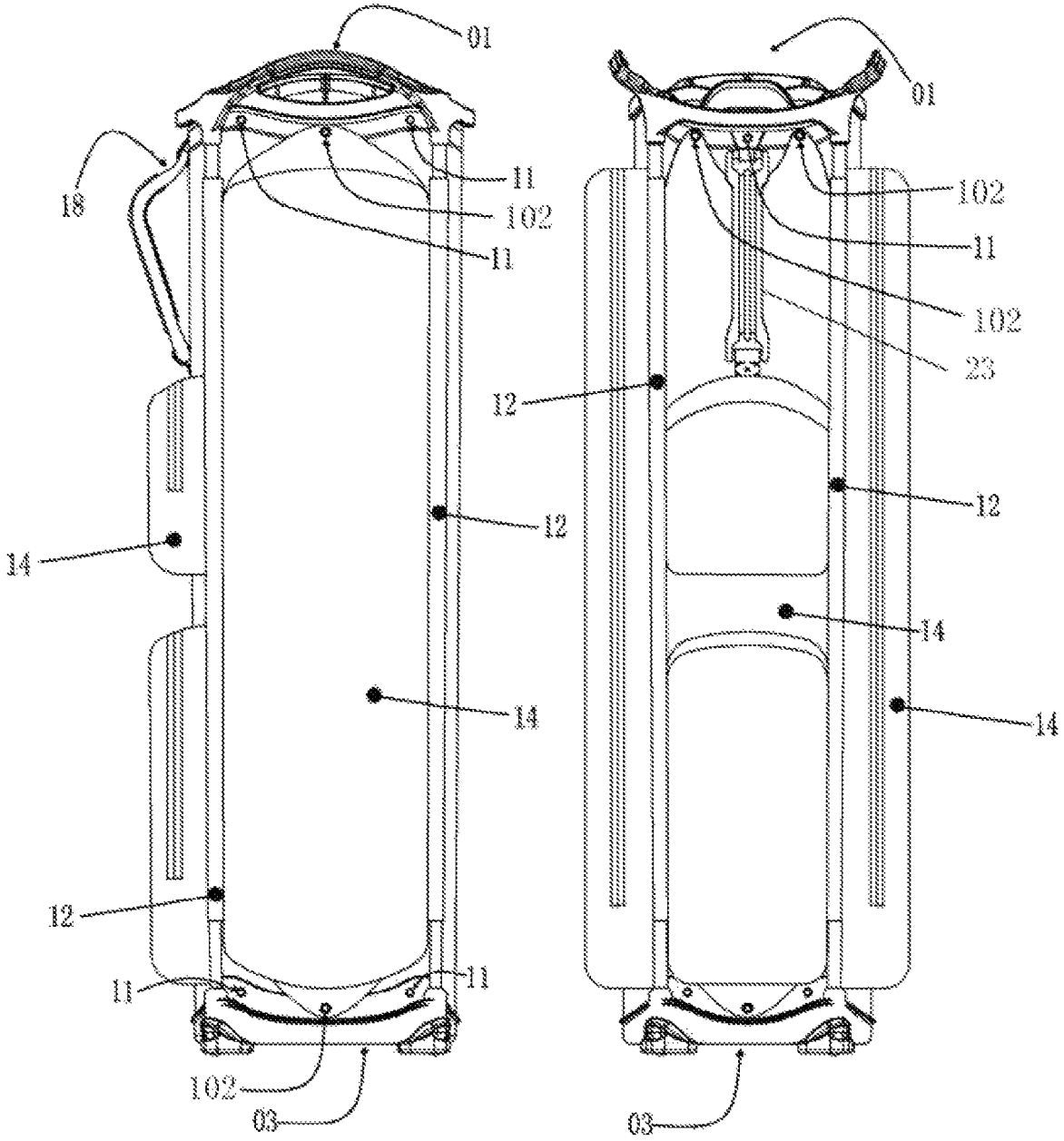
FIG. 10 is an assembled view of an assembled golf bag.

As shown in FIG. 8 and FIG. 9, the clamping strips 13 are fixed to the left outer wall and the right outer wall of the secondary body piece 14 through secondary body piece stitches 15; and secondary body piece buttons 102 are locked at the upper end and the lower end of the secondary body piece 14 of the golf bag.

As shown in FIG. 6 to FIG. 10, clamping strips 13 on the left outer walls and the right outer walls of the golf bag secondary body piece 14 are clamped into the support rod clamping grooves 121 respectively; then the secondary body piece buttons 102 on the secondary body piece 14 of the golf bag are correspondingly buckled with the main body piece buttons 101; and the secondary body piece 14 can be fixed to the main body piece 02 and the support rod 12.

When the secondary body piece 14 need to be changed, the secondary body piece buttons 102 are opened only, and the secondary body piece 14 can be easily taken down through the structures of the clamping strips 13 and the clamping grooves 121.

As shown in FIG. 6 to FIG. 10, the clamping strips 13 on the left outer walls and the right outer walls of the secondary body piece 14 of the golf bag can be clamped into the clamping grooves 061 and the support rod clamping grooves 121 respectively according to different position requirements.

Figure 11:
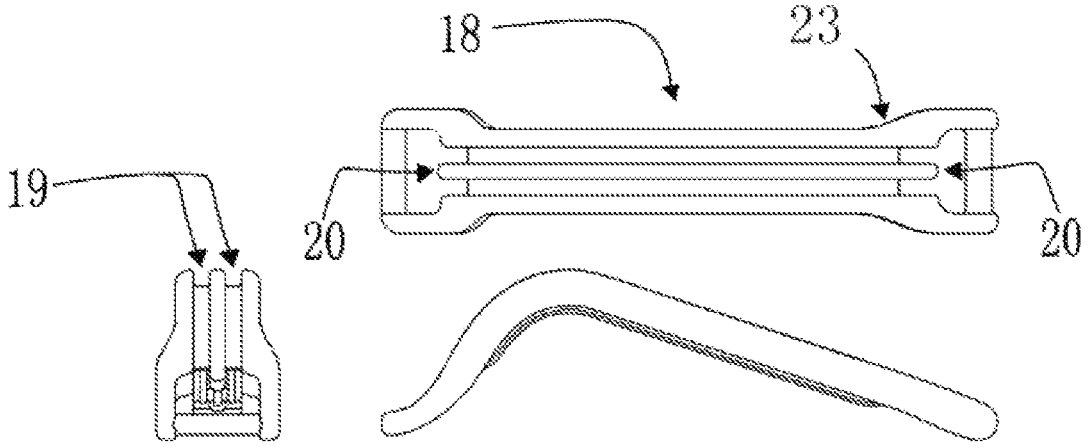
FIG. 11 shows three views of a handle body of an assembled golf bag.
Figure 12:
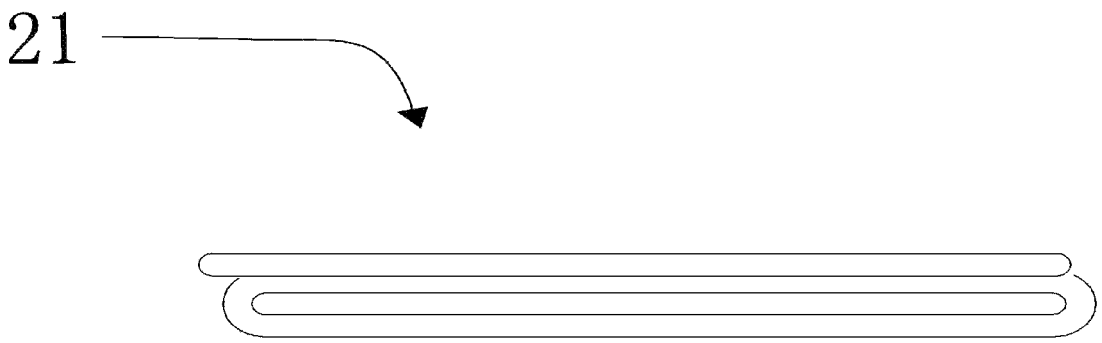
FIG. 12 is a schematic diagram of an adhesive tape of an assembled golf bag.
Figure 13:
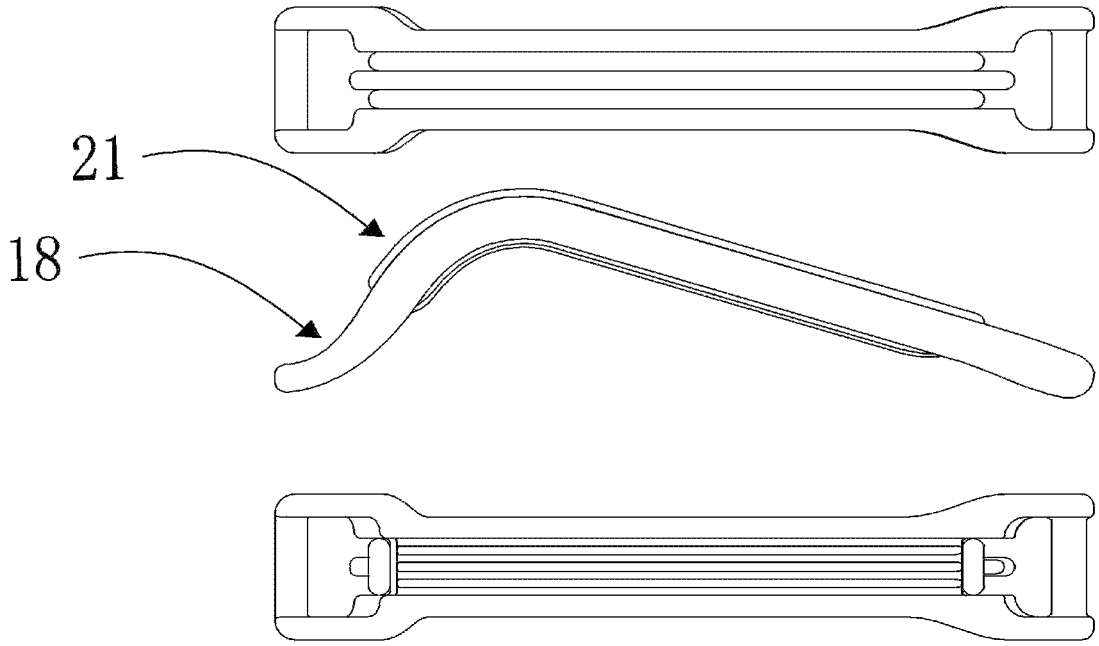
FIG. 13 is an assembled view of a handle body and an adhesive tape of an assembled golf bag.

As shown in FIG. 11 to FIG. 13, handle grooves 19 and handle barbs 20 are formed in the handle body 18; the adhesive tapes 21 with different sizes and different colors can be loaded in the handle grooves 19 respectively; both ends of the adhesive tapes 21 are hung on the handle barbs 20 respectively and are fixed in the corresponding handle grooves 19; and the size and the color of the handle 23 can be changed as long as the adhesive tapes 21 are replaced.

The support rod clamping grooves 121, the clamping grooves 061, the clamping strips 13 and the handle adhesive taps 21 can be in any shape of a circular shape, an oval shape, a square shape and a polygonal shape.

For those skilled in the art, the present invention is not limited to the details of the embodiments described above and can be implemented in other specific forms without deviating from the basic features of the present invention. Therefore, the embodiments should be considered as illustrative and not limiting in all respects. Many features and advantages of the present invention, including details and advantages, may have similar variations, particularly about similar structures and shapes, in the aspects of processing and manufacturing, and belong to the protection scope of the present invention.

What is claimed is:

1. An assembled golf bag, comprising:

an upper frame, a bottom frame, a support rod, a main body piece, a secondary body piece and a handle;

wherein an outer wall of the support rod is provided with a support rod clamping groove;

grid bars are provided in the main body piece; a plurality of main body piece clamping groove strips are arranged on the outer wall of the main body piece; main body piece button is arranged at both the upper end and the lower end of the main body piece; and the main body piece clamping groove strips are provided with clamping grooves;

the clamping strips are arranged on the left and the right outer walls of the secondary body piece, and secondary body piece buttons are arranged at the upper end and the lower end of the secondary body piece respectively; and a handle capable of being freely assembled is arranged on the assembled golf bag.

2. The assembled golf bag of claim 1, wherein the clamping strips are arranged in the support rod clamping grooves in a clamping mode, so that the secondary body piece are placed between the plurality of support rod.

3. The assembled golf bag of claim 1, wherein each clamping strip is arranged in the clamping groove in the clamping mode, so that the secondary body piece are placed between the plurality of main body piece clamping groove strips.

4. The assembled golf bag of claim 1, wherein one of the clamping strips is arranged in the support rod clamping groove in the clamping mode; and the other clamping strip is arranged in the clamping groove in the clamping mode, so that the secondary body piece are arranged among the support rod and the main body piece clamping groove strips.

5. The assembled golf bag of claim 1, wherein the main body piece buttons are correspondingly buckled with the secondary body piece buttons.

6. The assembled golf bag of claim 1, wherein the handle capable of being freely assembled is composed of a handle body and adhesive tapes; the handle body is provided with grooves; barbs are arranged at both ends of the handle body respectively; the adhesive tapes are placed into the grooves of the handle body; and both ends of the adhesive tapes are hung on the barbs.

7. The assembled golf bag of claim 1, wherein the support rod clamping grooves, the clamping grooves in the main body piece clamping groove strips, the clamping strips and the handle adhesive tapes can be in any shape of a circular shape, an oval shape, a square shape or a polygonal shape.

8. The assembled golf bag of claim 1, wherein the main body pieces provided with the main body piece clamping groove strips in the outer wall and provided with the grid bar in the main body pieces are fixed together with the upper frame and the bottom frame to form a whole body through rivets; then a plurality of support rod, of which the outer walls are provided with the support rod clamping grooves respectively, are loaded; upper frame support rod holes are formed in the upper frame; bottom frame support rod holes and buckling feet are formed in the bottom frame; buckling feet on the bottom frame are buckled after the support rod are fixed to the upper frame support rod holes and the bottom frame support rod holes; finally, the clamping strips on the secondary body piece are clamped into the support rod hole clamping grooves and the clamping grooves of the main body piece clamping groove strips respectively, and then the main body piece buckling buttons and the secondary body piece buckling buttons are correspondingly buckled.

9. The assembled golf bag of claim 2, wherein the main body pieces provided with the main body piece clamping groove strips in the outer wall and provided with the grid bar in the main body pieces are fixed together with the upper frame and the bottom frame to form a whole body through rivets; then a plurality of support rod, of which the outer walls are provided with the support rod clamping grooves respectively, are loaded; upper frame support rod holes are formed in the upper frame; bottom frame support rod holes and buckling feet are formed in the bottom frame; buckling feet on the bottom frame are buckled after the support rod are fixed to the upper frame support rod holes and the bottom frame support rod holes; finally, the clamping strips on the secondary body piece are clamped into the support rod hole clamping grooves, and then the main body piece buckling buttons and the secondary body piece buckling buttons are correspondingly buckled.

10. The assembled golf bag of claim 3, wherein the main body pieces provided with the main body piece clamping groove strips in the outer wall and provided with the grid bar in the main body pieces are fixed together with the upper frame and the bottom frame to form a whole body through rivets; then a plurality of support rod, of which the outer walls are provided with the support rod clamping grooves respectively, are loaded; upper frame support rod holes are formed in the upper frame; bottom frame support rod holes and buckling feet are formed in the bottom frame; buckling feet on the bottom frame are buckled after the support rod are fixed to the upper frame support rod holes and the bottom frame support rod holes; finally, the clamping strips on the secondary body piece are clamped into the clamping grooves of the main body piece clamping groove strips, and then the main body piece buckling buttons and the secondary body piece buckling buttons are correspondingly buckled.

11. The assembled golf bag of claim 4, wherein the main body pieces provided with the main body piece clamping groove strips in the outer wall and provided with the grid bar in the main body pieces are fixed together with the upper frame and the bottom frame to form a whole body through rivets; then a plurality of support rod, of which the outer walls are provided with the support rod clamping grooves respectively, are loaded; upper frame support rod holes are formed in the upper frame; bottom frame support rod holes and buckling feet are formed in the bottom frame; buckling feet on the bottom frame are buckled after the support rod are fixed to the upper frame support rod holes and the bottom frame support rod holes; finally, the clamping strips on the secondary body piece are clamped into the support rod hole clamping grooves and the clamping grooves of the main body piece clamping groove strips respectively, and then the main body piece buckling buttons and the secondary body piece buckling buttons are correspondingly buckled.

12. The assembled golf bag of claim 5, wherein the main body pieces provided with the main body piece clamping groove strips in the outer wall and provided with the grid bar in the main body pieces are fixed together with the upper frame and the bottom frame to form a whole body through rivets; then a plurality of support rod, of which the outer walls are provided with the support rod clamping grooves respectively, are loaded; upper frame support rod holes are formed in the upper frame; bottom frame support rod holes and buckling feet are formed in the bottom frame; buckling feet on the bottom frame are buckled after the support rod are fixed to the upper frame support rod holes and the bottom frame support rod holes; finally, the clamping strips on the secondary body piece are clamped into the support rod hole clamping grooves and the clamping grooves of the main body piece clamping groove strips respectively, and then the main body piece buckling buttons and the secondary body piece buckling buttons are correspondingly buckled.

* * * * *